US006474050B1

(12) United States Patent
Tetenborg

(10) Patent No.: US 6,474,050 B1
(45) Date of Patent: Nov. 5, 2002

(54) DEVICE FOR FILLING AND SEALING SACKS

(75) Inventor: Konrad Tetenborg, Lengerich (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/564,556

(22) Filed: May 4, 2000

(30) Foreign Application Priority Data

May 4, 1999 (DE) ..... 199 20 455
Jul. 16, 1999 (DE) ..... 199 33 486

(51) Int. Cl.[7] ..... B65B 43/26
(52) U.S. Cl. ..... 53/570; 53/567
(58) Field of Search ..... 53/525, 567, 570, 53/375.3

(56) References Cited

U.S. PATENT DOCUMENTS

| | | | | |
|---|---|---|---|---|
| 4,510,736 A | * | 4/1985 | Muller | 53/567 |
| 4,873,815 A | * | 10/1989 | Tetenborg et al. | 53/570 |
| 5,086,609 A | * | 2/1992 | Tetenborg | 53/570 |
| 5,448,879 A | * | 9/1995 | Concetti | 53/570 |
| 5,819,509 A | * | 10/1998 | McGregor et al. | 53/525 |

FOREIGN PATENT DOCUMENTS

| | | |
|---|---|---|
| DE | 28 19 689 | 11/1979 |
| DE | 37 13 571 | 11/1988 |
| DE | 93 01 355 | 1/1994 |
| EP | 0 290 879 | 11/1988 |
| EP | 0 468 376 | 1/1992 |
| EP | 0 844 175 | 5/1998 |

* cited by examiner

*Primary Examiner*—John Sipos
(74) *Attorney, Agent, or Firm*—Jacobson Holman, PLLC

(57) ABSTRACT

The invention relates to a device for filling and sealing sacks, which are open on one side and are provided preferably with side folds. Said device comprises a filling station, which exhibits a filling pipe and serves the purpose of filling sacks; comprises various grippers for transporting away the empty sacks; holding the sacks in the filling station and transporting away the filled sacks, and comprises a conveyor belt, which starts below the filling station and serves the purpose of bracing and carrying away the filled sacks. Said conveyor belt exhibits at least one stand that revolves around two deflecting rollers. According to the invention, the conveyor belt in the region below the filling station can be lowered and raised again by swivelling the deflecting roller. Below the carrying run of the conveyor belt there is an additional vibrator in the region of the filling station.

16 Claims, 4 Drawing Sheets

DEVICE FOR FILLING AND SEALING SACKS

BACKGROUND OF THE INVENTION

1. Field of the Invention

The invention relates to a device for filling and sealing sacks, which are open on one side and are provided preferably with side folds.

2. Description of the Related Art

Such a device is disclosed, for example, in the EP 290 879 A2 and DE 93 01 355 U. The device described therein exhibits a filling station, which exhibits a filling pipe and serves the purpose of filling sacks preferably with granules or dust-like filling material. The device exhibits various grippers for transporting the empty sacks, holding the sacks in the filling station and for transporting away the filled sacks in the device. Below the filling station is a conveyor belt for bracing and for carrying away the filled sacks from the filling station. This conveyor belt exhibits at least one stand that revolves around two deflecting rollers. In the prior art devices the bottom welds are affixed to the thermoplastic tube, which is hauled off a supply roller, in a region before the filling station. If at this point the device is driven at a high cycle rate, the bottom weld has not cooled and thus has not reached its final hardness at the time the sack is delivered to the filling station and filled there. If then the sack is suddenly filled by means of the filling funnel, thus putting a sudden stress on the bottom weld, the sack can split. The result is that the machine has to be shut down.

A device for filling sacks is also discloses in the EP 468 376 B2. In this device a conveyor belt is arranged below the filler. A part of the conveyor belt can be swung away. On this part rests the empty sack with the bottom end turned up so that the seam is not excessively stressed at the first filling shot. As the filling procedure continues, the part of the belt that is under the sack swings away downwardly so that the bottom can form. Once this has happened, this part of the belt continues to swing up and down rhythmically in order to compress the fill material. The drawback with this procedure is that when thin walled sack material is used, the material in the area of the top holding pliers is stressed to the point that it stretches so that the sack can be damaged. Another drawback with this device lies in the fact that relatively large masses have to be moved in the vibrating and compressing process.

SUMMARY OF THE INVENTION

The object of the invention is to provide a device of this class, that guarantees both a flawless bottom formation during the filling process and secondly flawless compression without having to move large masses.

The invention solves this problem associated with this class of device. In this respect the conveyor belt in the region below the filling station can be lowered and raised again by swivelling the deflecting roller. Below the carrying run of the conveyor belt there is an additional vibrator in the region of the filling station. This design of the conveyor belt allows the sack, held in the filling station, to be safely filled. Then the unfilled sack with the bottom weld, which has not yet completely cooled, is hung in the filling station, where the grippers of the filling station grasp the sack at its open end. The closed end of the sack lies on the carrying run of the conveyor belt. Said carrying run is arranged below the filling station. The distance from the filling station to the carrying run of the conveyor belt is less than the length of the unfilled sack. Therefore, the bottom end of the yet unfilled sack lies bent over on the carrying run of the conveyor belt. As the sack is being filled, the sudden impact of the filling procedure is attenuated in that the fill strikes the floor of the conveyor belt and does not suddenly stress the weld region in the bottom seam that has not completely cured yet. Following this damped prefilling, there is the problem of the sack forming a good bottom. For this purpose the deflecting roller, mounted on this end of the conveyor belt, is lowered. To compress the fill material, the conveyor belt is set vibrating by means of the vibrator, mounted below the carrying run in the filling station area, for the purpose of giving the sack bottom suitable jolts in order to compress the fill material.

Advantageous embodiments of the invention follow from the dependent claims that refer back to the main claim.

Correspondingly the deflecting roller can be swivelled by means of a pneumatically or hydraulically driven lever bar.

Whereas the deflecting roller of the conveyor belt can be raised and lowered periodically, the sack bottom can be vibrated at a low frequency during the filling process, as described above.

Posts that run crossways can be mounted on the conveyor belt. The distance between the posts can be selected in such a manner that they can accommodate a filled sack between any two posts. If such transverse posts are present, there is the problem that the empty sack segments arriving by means of a pair of transport gripper may strike, during delivery in the filling station, i.e. to the grippers of the filling station, with their freely hanging ends against the posts; and consequently the free end is not correctly deposited on the conveyor belt between the posts. Therefore, the invention solves this problem by arranging a bar, which runs at right angle to the direction of transport, in front of and above the conveyor belt in the opposite conveying direction of the sacks, conveyed into the filling station by the grippers. The sacks can be pulled over the bar in such a manner that the sacks are deposited by means of a specific swivel motion with the sack bottom between two posts of the conveyor belt.

The entire conveyor belt can be vertically adjusted in the machine frame. Thus, it is easy to adapt to the different sack sizes.

BRIEF DESCRIPTION OF THE DRAWINGS

Other details and advantages of the invention are explained with reference to one of the embodiments depicted in the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In accordance with the description in the EP 290 879 A2, a device for filling and sealing sacks that are open on one side is apart of a system for manufacturing sacks, filling sacks with fill material and for transporting away the filled sacks. This device will be described in detail below.

Figure 1:
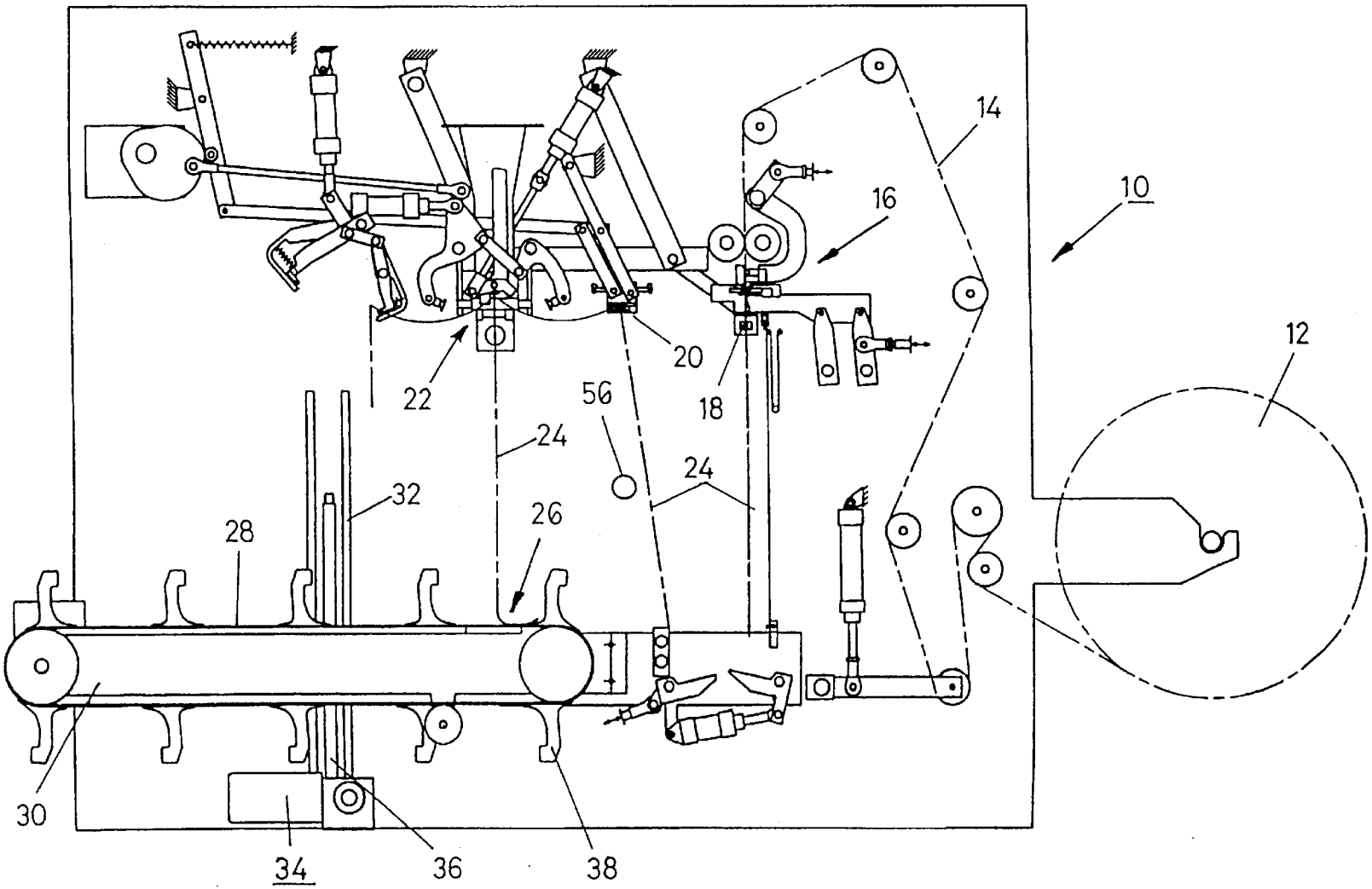
FIG. 1 is a side view of an embodiment of the device of the invention for filling and sealing sacks.

FIG. 1 is a global view of such a device for manufacturing sacks, filling sacks with a fill material and for transporting away the filled sacks. The entire system is labelled 10. A tube, which is made of a thermoplastic polymer 14 and is provided with side folds, is hauled off a supply roll 12 and fed to a first welding station 16 to form the bottom seam. The sack segments, provided with the bottom seam and severed by means of a conventional knife, are passed by means of a pair of grippers 18, 20 to a filling station 22. There the respective sack segment 24 is grasped and held by stationary fill grippers.

The free end 26 of the sack 24 lies on the top carrying run 28 of a conveyor belt 30, which starts below the filling station 22.

The conveyor belt 30 can be adjusted vertically. The center of the support beam of the conveyor belt 30 exhibits a horizontal bracket with guide jaws, which slide between guides 32, illustrated in FIG. 2. To raise and lower the conveyor belt 30, there is a gear motor 34 with a drivable spindle 36, by means of which a continuous vertical adjustment of the conveyor belt can taken place. The vertical adjustment of the conveyor belt is necessary for adjusting to the different sizes, i.e. lengths, of the sacks 24.

The conveyor belt 30 (illustrated here) exhibits transverse posts 38, which serve to facilitate the transport of the sacks 24 filled with loose material.

Figure 2:
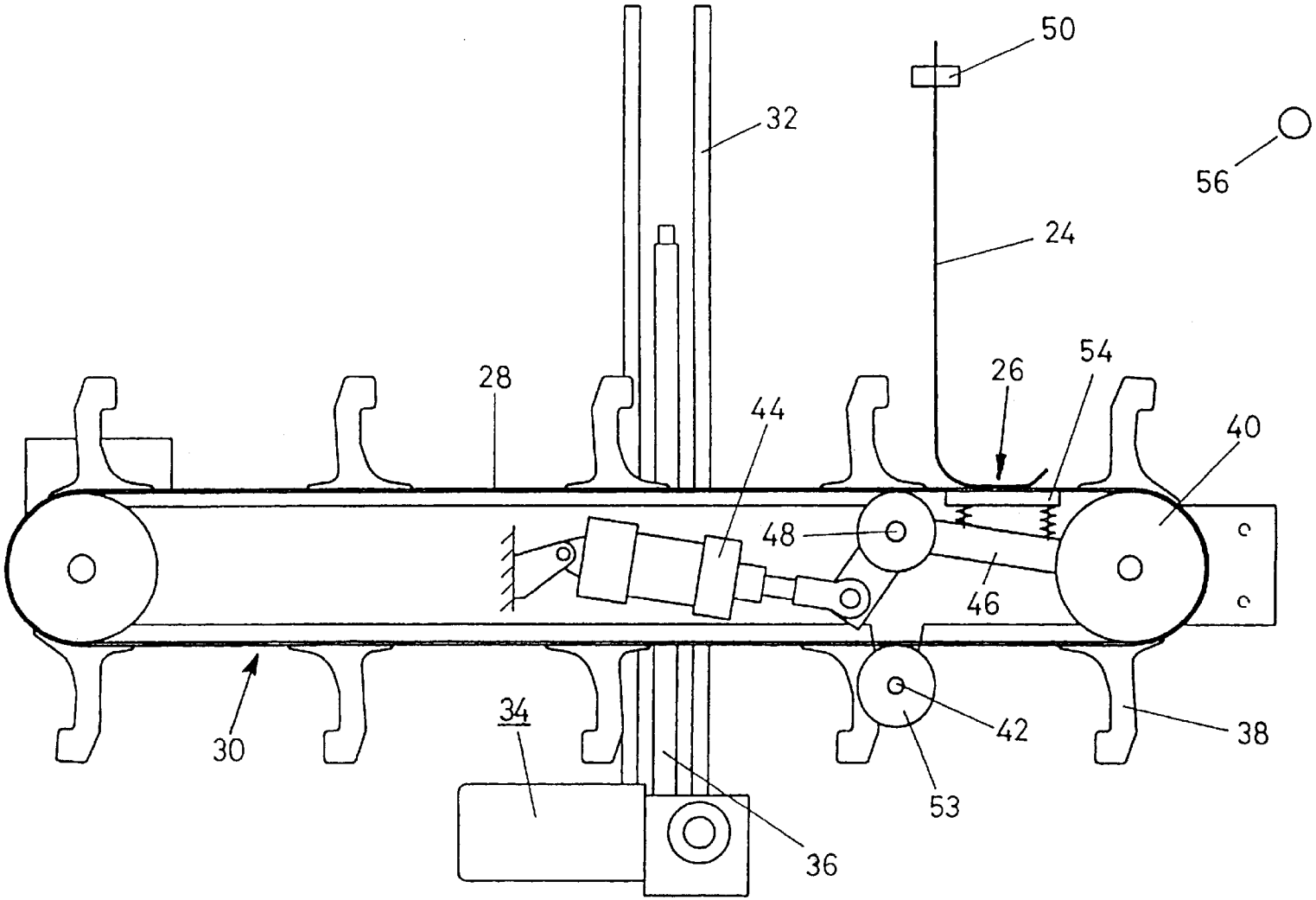
FIG. 2 is an enlarged detail of FIG. 1.

As especially evident from FIG. 2, the deflecting roller 40 can be swung away from the free end of the conveyor belt 30, which is under the filling station. The deflecting roller 40 is mounted on the side using side plates in a manner that is not illustrated in detail. These side plates can be pivoted around a swivel bearing 42 (cf. FIG. 2). The swivelling takes place by means of a pneumatic piston arrangement 44, which can swivel the deflecting roller 40 by means of a swivel lever mechanism 46, rotated around a point of rotation 48.

The individual steps of the filling process of the sack 24 are explained with reference to FIGS. 2 to 4.

In FIG. 2 a sack 24 is grasped by a pair of grippers 50 in the filling station 22. The bottom end 26 with the yet incompletely cured weld (not illustrated here) lies bent over on the top carrying run 28 of the conveyor belt 30. The intermittently moveable conveyor belt is standing still in this phase. In the filling station the sack 24 is now filled by the conventional method. Owing to the arrangement of the sack 24, as described above, the fill material does not directly stress the bottom weld. Of course, the sack bottom is not formed as desired in this arrangement.

Figure 3:
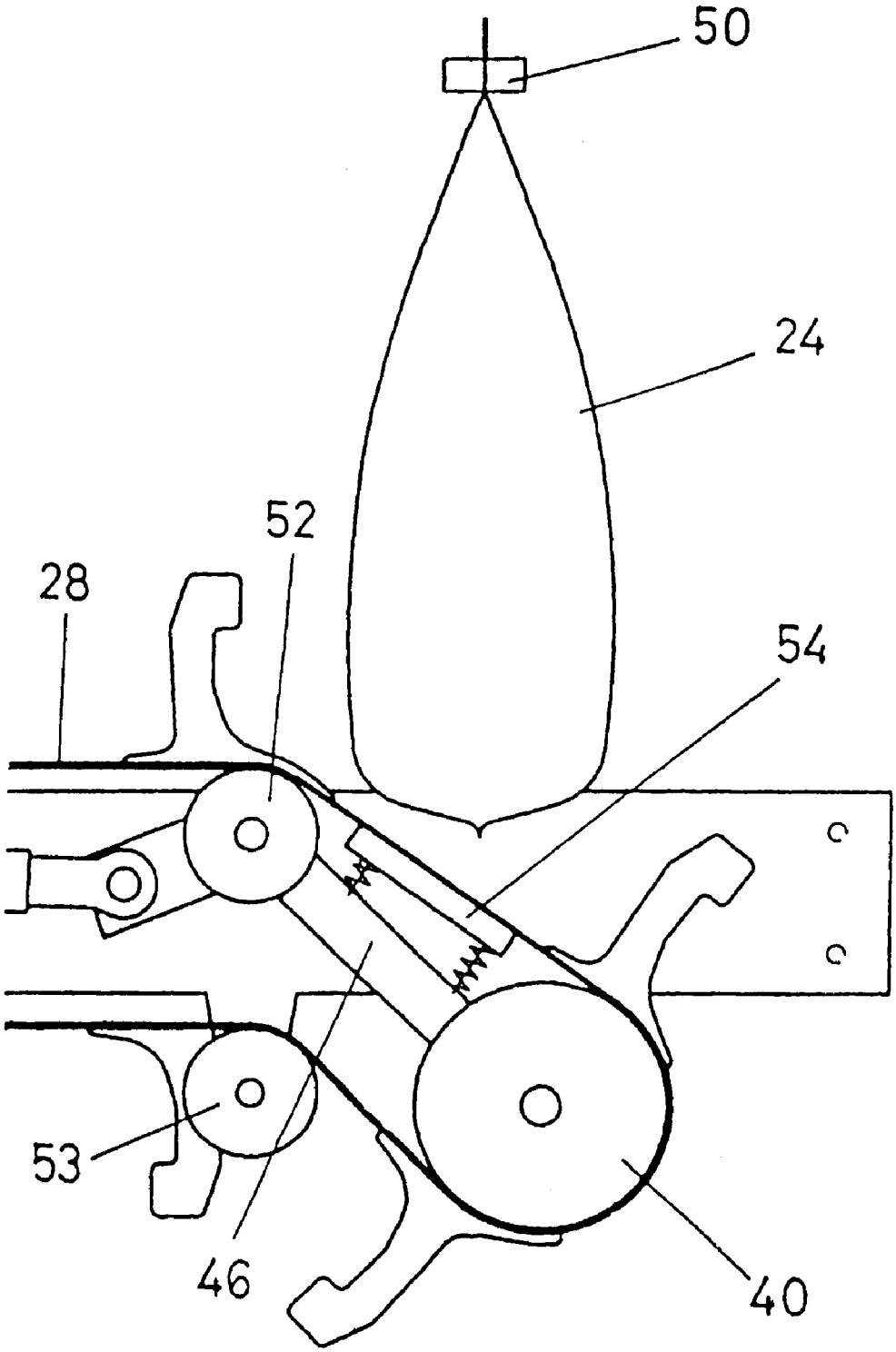
FIG. 3.
Figure 4:
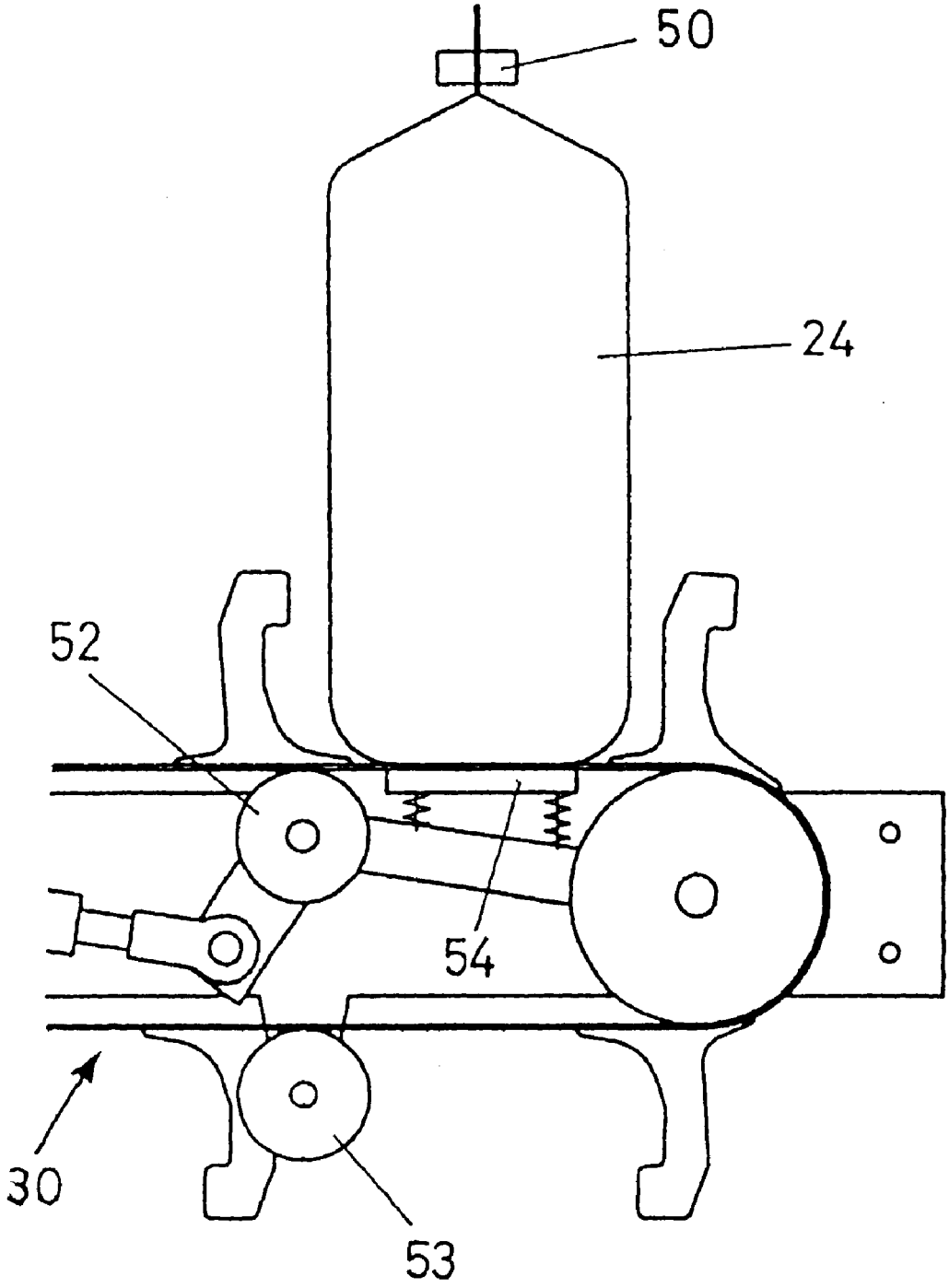
FIG. 4 are a view of an enlarged detail of FIG. 2, in different operating positions.

Therefore, as shown in FIG. 3, the deflecting roller 40 and thus the entire end of the conveyor belt 30 is swung downward by means of the rod 46 so that the sack 24 that is now in the process of being filled hangs freely downward. While the conveyor belt 30 is swung away, the top carrying run 28 is supported by a deflecting roller 52. Finally during the filling process, as shown in FIG. 4, the conveyor belt is swung back again into the starting position. The swinging back and forth of the swivelable end of the conveyor belt 30 can be repeated periodically in order to compress the loose material in the sack 24. For more intensive compression of the loose material, a vibrator 54, whose construction is well known, is arranged below the top carrying run 28 of the conveyor belt 30. It vibrates the sack bottom at a higher frequency, as illustrated in FIG. 4. After the sack 24 has been filled, it is grasped in the conventional manner by another pair of transport grippers and transported to a welding station for welding the open side. During this travel motion the conveyor belt 30 continues to move for the purpose of transporting the sack.

In FIGS. 1 and 2 there is a bar 56 at right angles to the conveying direction of the sack 24 conveyed to the filling station. The sack 24, which is moved with the pair of grippers 20 to the filling station, is pulled over the bar. During transport to the filling station, the end of the sack 24, pulled over the bar 56, swings between two posts 38 of the conveyor belt 30 so that the end 26 of the sack 24 is deposited accurately into the space between the two posts 38, as shown in FIGS. 1 and 2, without striking the post 38.

The bottom run of the conveyor belt rest against the support rollers 53 while the conveyor belt is swung away.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for filling and sealing sacks which are open on one side, comprising:

a filling station for filling sacks;

a plurality of grippers for transporting empty sacks, holding sacks while at the filling station and transporting filled sacks from the filling station;

a conveyor belt for bracing and carrying away the filled sacks on a carrying run, said conveyor belt having a first end which starts in a region below the filling station and is supported under the filling station, means for raising and lowering, the first end of said conveyor belt, said raising and lowering causing fill material in the sack undergoing said sack filling operation to settle; and a vibrator movable with and in contact with an underside of said carrying run of the first end of said conveyor in the region below said filling station to vibrate a bottom of said sack to compress said fill material in said sack when said first end is raised.

2. The device as set forth in claim 1, wherein said bottom of said sack being filled in said sack filling operation is unsupported by said first end when said first end is lowered.

3. The device as set forth in claim 1, wherein said means for raising and lowering comprising a lever bar driven by a pneumatic/hydraulic piston device to raise and lower said first end.

4. The device as set forth in claim 3, wherein said vibrator is coupled to an upper surface of said lever bar.

5. The device as set forth in claim 1, further comprising:

a plurality of posts that run crossways on said conveyor belt to separate filled sacks; and a bar which runs perpendicular to a direction of transport on said conveyor belt, in front of and above said conveyor belt relative to said direction of transport, a sack incoming to said conveyor belt being pulled over said bar and deposited, through a swivel motion, between two of said plurality of posts of said conveyor belt.

6. The device as set forth in claim 5, wherein said two posts are positioned on the carrying run before and after the region of the filling station.

7. A device for filling and sealing sacks which are open on one side, comprising:

a filling station having a filling pipe for filling sacks;

a plurality of grippers for transporting empty sacks, holding sacks while at the filling station and transporting filled sacks from the filling station;

a conveyor belt for bracing and carrying away the filled sacks on a carrying run, said conveyor belt having a first end which starts in a region below the filling station and is supported by a deflecting roller coupled to a swivel lever mechanism, said deflecting roller being raised and lowered by moving said swivel lever mechanism so as to raise and lower the first end of said conveyor belt during a sack filling operation; and a vibrator coupled to and movable with said swivel lever mechanism and in contact with an underside of said carrying run in the region below said filling station.

8. The device as set forth in claim 7, wherein a bottom of the sack being filled in said sack filling operation is unsupported by said first end when said first end is lowered and, when said first end is raised, said bottom is supported by said first end such that said vibrator vibrates said sack bottom to compress said fill material in said sack.

9. The device as set forth in claim 7, wherein said swivel lever mechanism includes a pneumatically driven piston.

10. The device as set forth in claim 7, wherein said swivel lever mechanism includes a hydraulically driven piston.

11. The device as set forth in claim 7, further comprising:

a plurality of posts that run crossways on said conveyor belt to separate filled sacks; and a bar which runs perpendicular to a direction of transport on said conveyor belt, in front of and above said conveyor belt relative to said direction of transport, a sack incoming to said conveyor belt being pulled over said bar and deposited between two of said plurality of posts of said conveyor belt without contacting an outer face of said two posts.

12. The device as set forth in claim 11, wherein said two posts are positioned on the carrying run before and after the region of the filling station.

13. In a device for filling and sealing sacks having a filling station for filling sacks and a plurality of grippers for transporting empty sacks, holding sacks while at the filling station and transporting filled sacks from the filling station, the combination of a conveyor belt and a vibrating element, said conveyor belt having a moveable portion in a region below the filling station, said moveable portion supported by a deflecting roller coupled to a swivel lever mechanism which is driven by a piston device for pivoting said moveable portion between a raised position and a lowered position, said vibrating element coupled to and moveable with said swivel lever mechanism and in contact with an underside of said conveyor belt in the region below said filling station when said moveable portion is in said raised position for vibrating a bottom of a sack being filled.

14. The combination as set forth in claim 13, wherein a bottom of the sack being filled is unsupported by said moveable portion when said moveable portion is in said lowered position.

15. The combination as set forth in claim 13, further comprising a plurality of posts that run crossways on said conveyor belt, and a bar which runs perpendicular to a direction of transport on said conveyor belt, in front of and above said conveyor belt relative to said direction of transport, a sack incoming to said conveyor belt being pulled over said bar and deposited, through a swivel motion, between two posts of said conveyor belt without contacting an outer face of said two posts.

16. The combination as set forth in claim 15, wherein said two posts are positioned on the conveyor belt before and after the region of the filling station.

* * * * *